US011661248B2

(12) United States Patent
Wang

(10) Patent No.: US 11,661,248 B2
(45) Date of Patent: May 30, 2023

(54) BACKWARD-FOLDED OPENING-RESISTANT CONTAINER STRUCTURE

(71) Applicant: SOUTH PLASTIC INDUSTRY CO., LTD., New Taipei (TW)

(72) Inventor: Tong-Chang Wang, New Taipei (TW)

(73) Assignee: SOUTH PLASTIC INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 17/495,814

(22) Filed: Oct. 7, 2021

(65) Prior Publication Data

US 2023/0010372 A1 Jan. 12, 2023

Related U.S. Application Data

(63) Continuation-in-part of application No. 17/368,773, filed on Jul. 6, 2021.

(51) Int. Cl.
*B65D 43/22* (2006.01)
*B65D 43/16* (2006.01)

(52) U.S. Cl.
CPC ..... *B65D 43/22* (2013.01); *B65D 43/162* (2013.01); *B65D 2543/00462* (2013.01); *B65D 2543/00574* (2013.01)

(58) Field of Classification Search
CPC ..... B65D 43/22; B65D 43/0285; B65D 43/0237; B65D 43/0235; B65D 43/0249; B65D 2543/00842
See application file for complete search history.

(56) References Cited

U.S. PATENT DOCUMENTS

| | | | | |
|---|---|---|---|---|
| 8,807,385 | B1 * | 8/2014 | Fosse | B65D 43/162 220/4.23 |
| 10,494,161 | B2 * | 12/2019 | Fosse | B65D 43/22 |
| 2007/0045317 | A1 * | 3/2007 | Rosender | B65D 43/0249 220/4.23 |
| 2009/0206082 | A1 * | 8/2009 | Vovan | B65D 43/0249 29/428 |
| 2015/0028033 | A1 * | 1/2015 | Samuel | B65D 43/162 220/270 |
| 2021/0237946 | A1 * | 8/2021 | Jackson | B65D 43/164 |

* cited by examiner

*Primary Examiner* — Jeffrey R Allen
(74) *Attorney, Agent, or Firm* — Leong C. Lei

(57) ABSTRACT

A backward-folded opening-resistant container structure includes first and second casing members combinable with each other. The first casing member has an outer side to which a foldable member that includes an insertion trough and an engaging member is connected. The second casing member includes a grip portion having a notch. A break-away unit includes a planar portion connected to the notch by means of a perforation line and a fastening portion in the form of a hollow cylindrical body having an end formed with an opening connected to the planar portion. The insertion trough and the fastening portion are combinable with each other, and the foldable member is foldable to have the engaging member inserted into the opening. When the first casing member and the second casing member are separated, the perforation line is broken and the break-away unit detaches from the second casing member.

3 Claims, 13 Drawing Sheets

BACKWARD-FOLDED OPENING-RESISTANT CONTAINER STRUCTURE

CROSS-REFERENCE TO RELATED APPLICATIONS

This is a continuation-in-part of co-pending U.S. patent application Ser. No. 17/368,773 filed on Jul. 6, 2021.

TECHNICAL FIELD OF THE INVENTION

The present invention relates to a container, and more particularly to a backward-folded opening-resistant container structure that is resistant against opening and is unrestorable upon opening.

DESCRIPTION OF THE PRIOR ART

Various plastic containers that are made through vacuum forming are available, including lower cases, cups, or bowls, for packaging food to keep the food fresh in supermarkets. Such products are generally made of clear materials, allowing general consumers to observe food therein in purchasing products in order to eliminate unnecessary arguing and quarrels after the sale. However, to inspect the food contained in such a container is intact and fresh, some consumers may open, without permission and authorization, the plastic container to directly inspect the food, and often, such products are not or cannot be restored to the original condition after such opening. This would lead loss of freshness for the food contained in the plastic container, and the plastic container is damaged and the outside appearance is affected. Further, if it is not timely recognized that the package container has been opened, the food contained therein may get deteriorating and this would cause a waste of food and is also an economic burden of the shops. In view of the above, the present invention aims to provide a backward-folded opening-resistant container structure, which achieves the purpose of opening preventing, opening recognizing, and unrestorability upon opening, in order to alleviate or overcome the drawbacks of the prior art and to improve the performance thereof.

SUMMARY OF THE INVENTION

In view of the above drawbacks, the present invention provides a backward-folded opening-resistant container structure, which comprises: a first casing member, a second casing member combinable with the first casing member, wherein the first casing member is provided, on an outer side thereof, with a foldable member, which has an end connected to the outer side of the first casing member and comprises an insertion trough and an engaging member; and the second casing member is provided, on an outer side thereof, with a grip portion, the grip portion comprising a notch; and a break-away unit, which comprises a planar portion and a fastening portion, the planar portion having an outer side that is connected by means of a perforation line to the notch, the fastening portion comprising a hollow cylindrical body having an end that comprises an opening, the opening having an outer side connected to the planar portion, wherein the insertion trough is correspondingly combinable with the fastening portion and the foldable member is foldable to have the engaging member inserted into the opening, so that when the first casing member and the second casing member are separated, the perforation line is broken and the break-away unit detaches from the second casing member.

DETAILED DESCRIPTION OF THE PREFERRED EMBODIMENT

Figure 1:
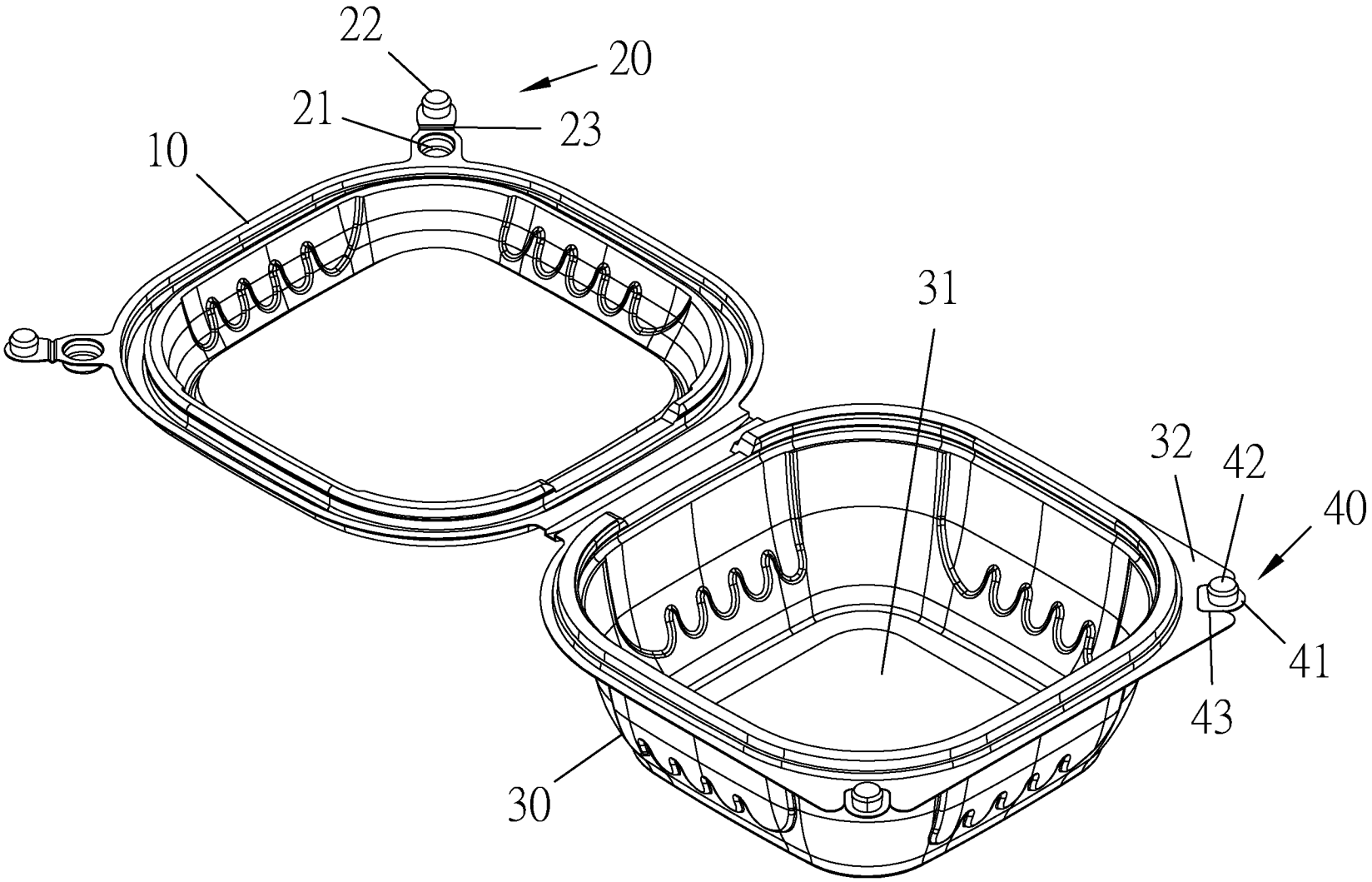
FIG. 1 is a perspective view showing a first embodiment of the present invention in an opened state.
Figure 2:
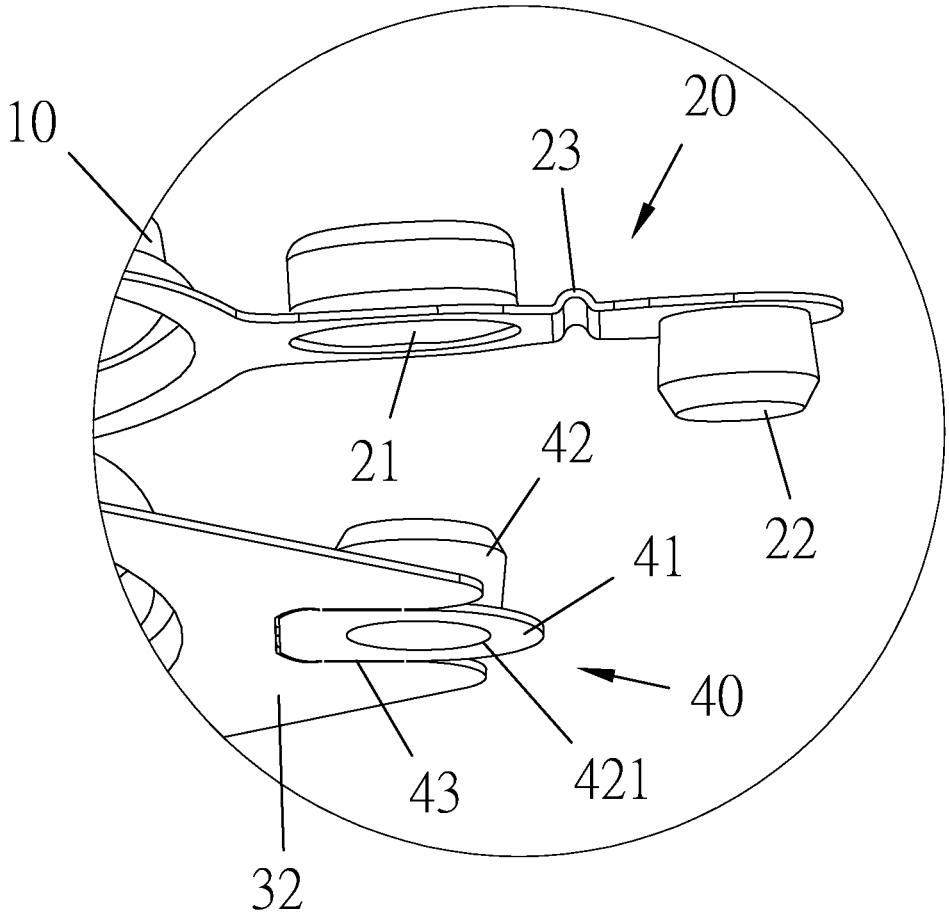
FIG. 2 is a perspective view showing a portion of the first embodiment of the present invention in an enlarged form.
Figure 3:
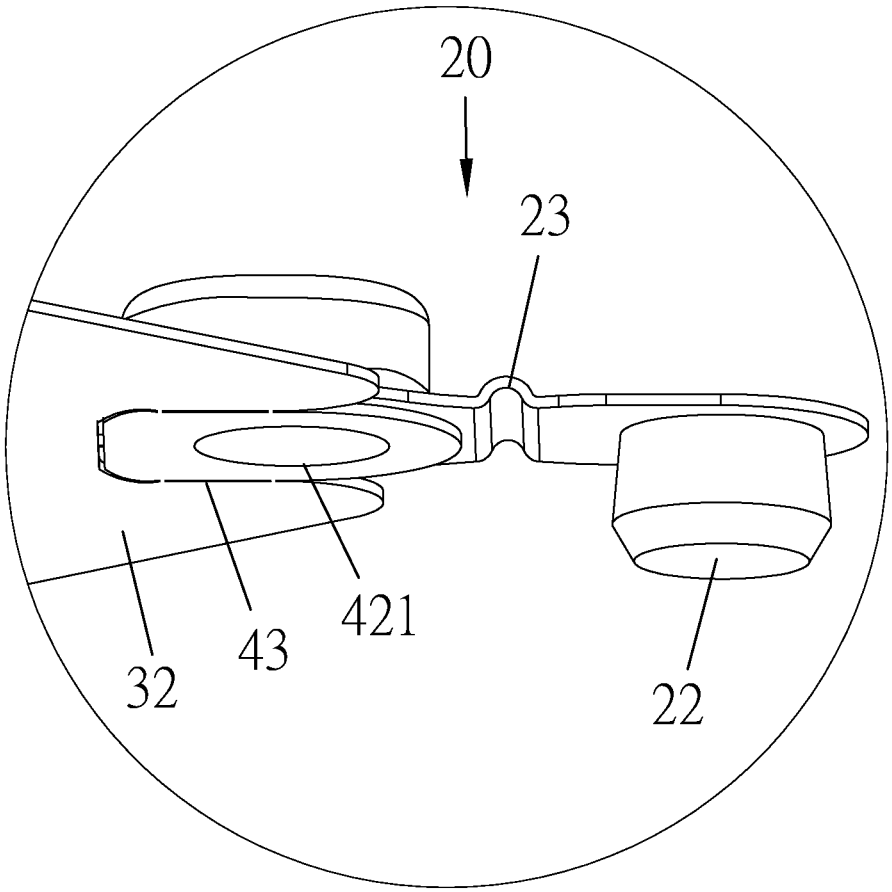
FIG. 3 is a perspective view showing a fastening portion received in an insertion trough according to the present invention.
Figure 4:
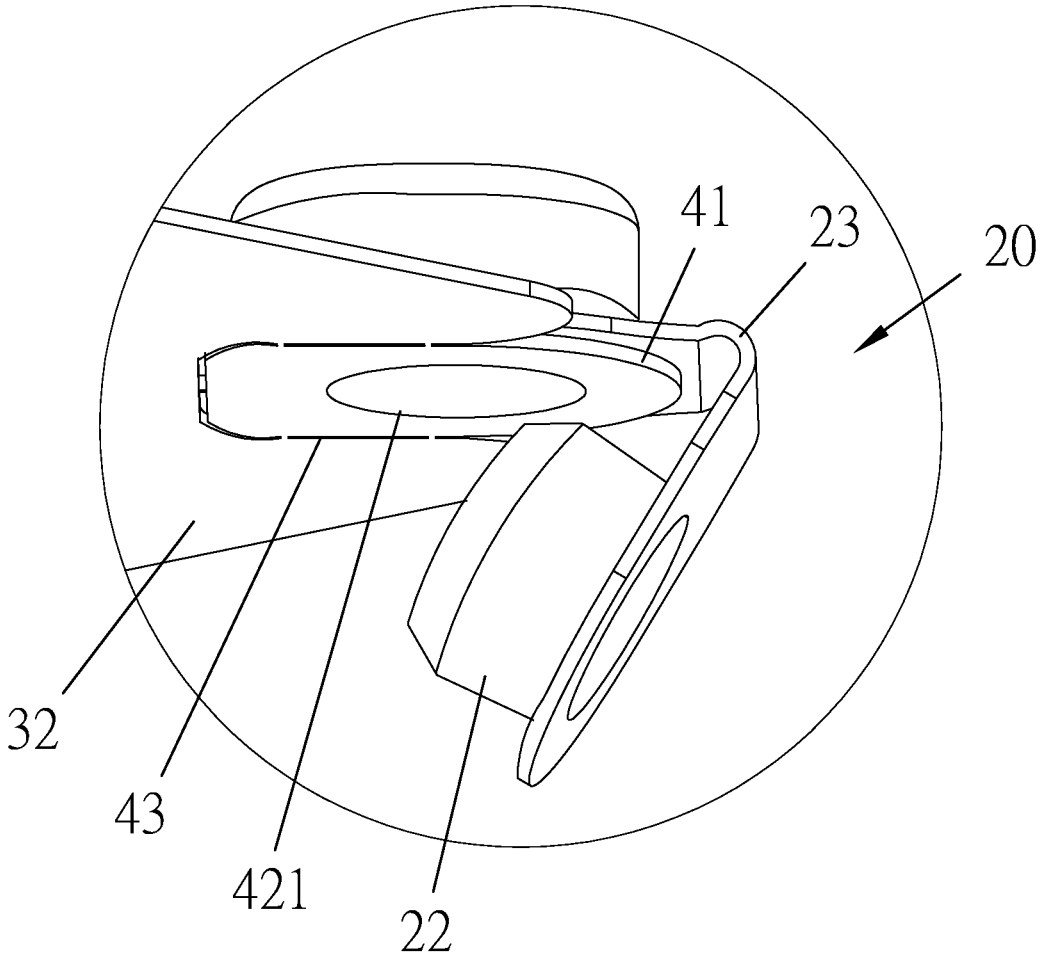
FIG. 4 is a schematic view, continuing from FIG. 3, showing a foldable member being folded.
Figure 5:
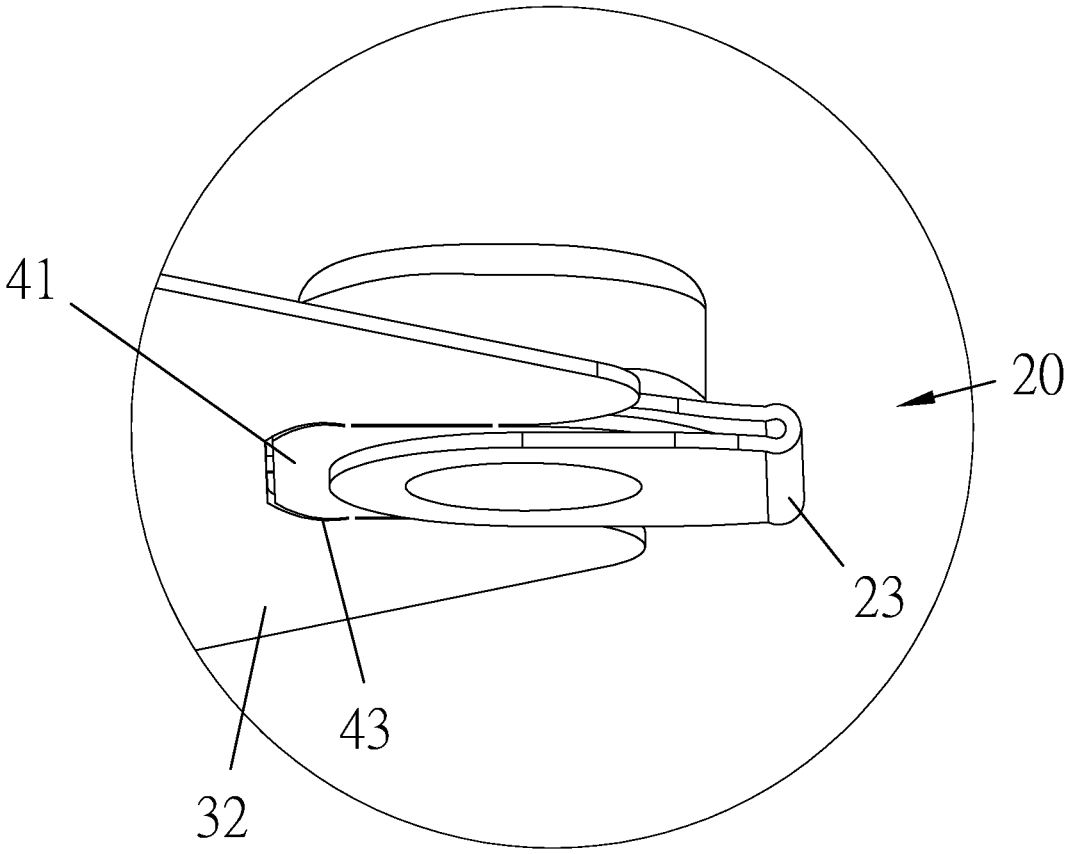
FIG. 5 is a perspective view, continuing from FIG. 4, showing an engaging member being combined with an opening.
Figure 6:
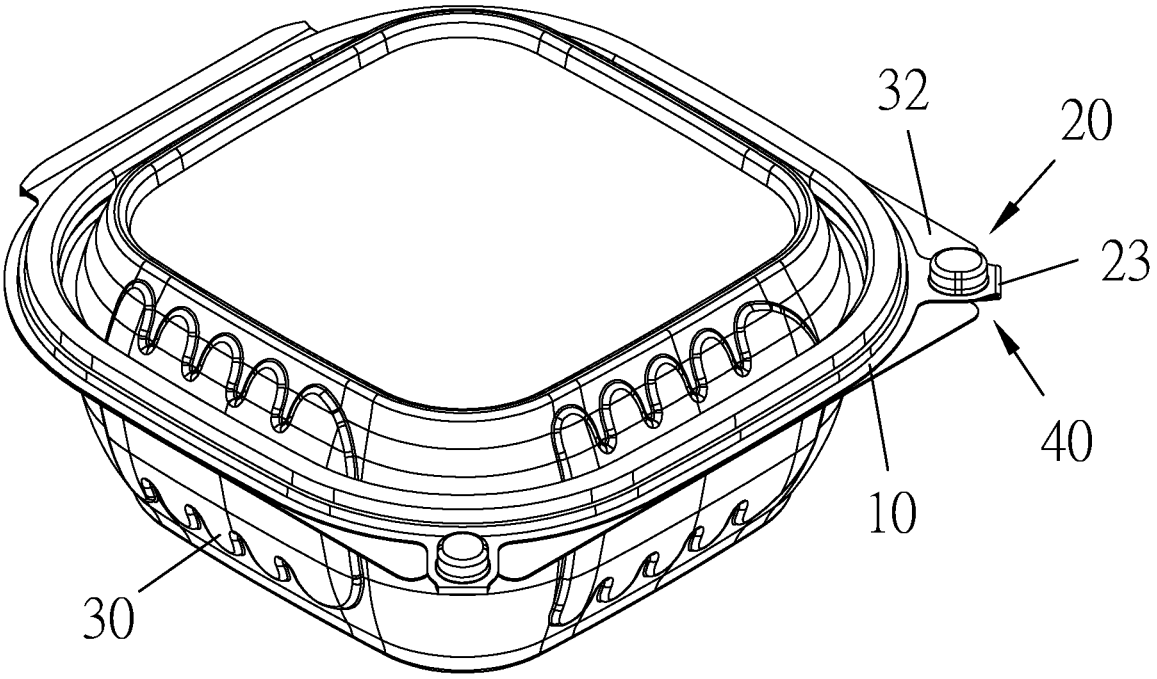
FIG. 6 is a perspective view showing the present invention in a closed state.

For easy description of the contents of the present invention, and the effectiveness achieved thereby, an embodiment is provided, with reference being had to the attached drawings. As shown in FIGS. 1 and 2, the present invention provides, in a first embodiment, a backward-folded opening-resistant container structure, which comprises:

a first casing member 10;

at least one foldable member 20, which has an end connected to an outer side of the first casing member 10 and comprises an insertion trough 21 and an engaging member 22, a folding portion 23 that is made elastic being included between the insertion trough 21 and the engaging member 22;

a second casing member 30, which has an interior that includes a receiving space 31 in communication with the outside, the first casing member 10 being combinable with the second casing member 30 in a detachable manner, in order to close the receiving space 31, the second casing member 30 having a top from which at least one grip portion 32 extends outward in a horizontal direction, the grip portion 32 comprising a notch 321; and a break-away unit 40, which comprises a planar portion 41 and a fastening portion 42, the planar portion 41 having an outer side that is connected by means of a perforation line 43 to the notch 321 (FIG. 6).

Referring to FIGS. 2-6, the fastening portion 42 includes a hollow cylindrical body having an end that includes an opening 421. The opening 421 has an outer side that is connected to the planar portion 41. The insertion trough 21 has a width that is greater than the fastening portion 42, so that when the first casing member 10 is combined with the second casing member 30, the fastening portion 42 is received in the insertion trough, and the foldable member 20 is then folded to have the engaging member 22 fit into and engaging with the opening 421 so as to be securely retained together to form a closed and thus protected state.

Further, the insertion trough 21 is not in contact with the fastening portion 42 and the function achieved thereby is equivalent to positioning and also protection of the fastening portion 42 from being pushed, squeezed, or damaged by an external force.

Figure 7:
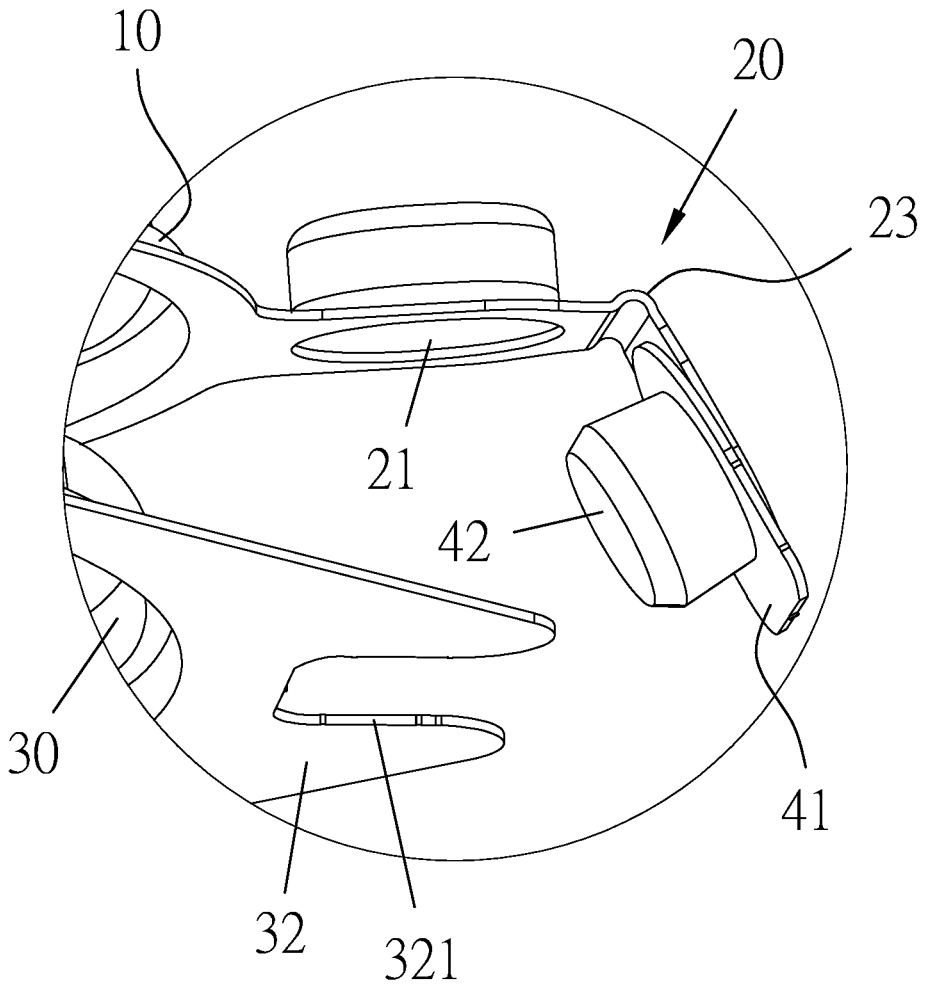
FIG. 7 is a schematic view, continuing from FIG. 5, illustrating a break-away unit being detached and separated from a notch.
Figure 8:
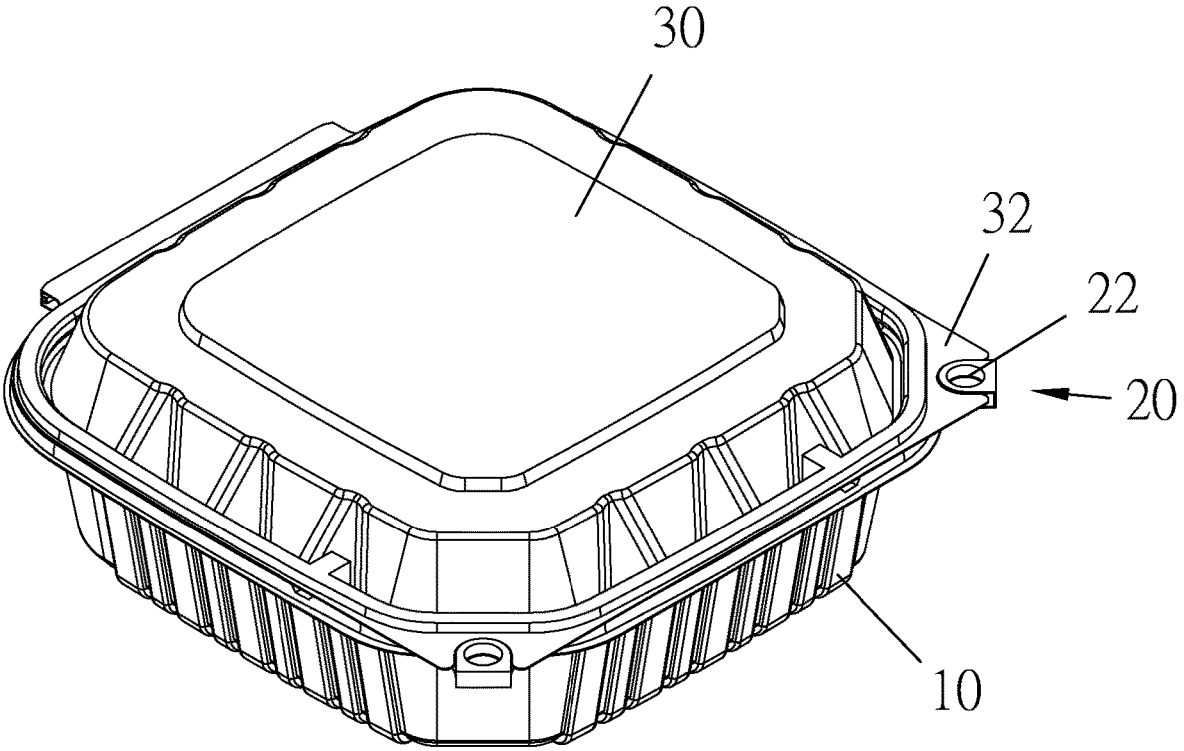
FIG. 8 is a perspective view showing a second embodiment of the present invention in a closed state.
Figure 9:
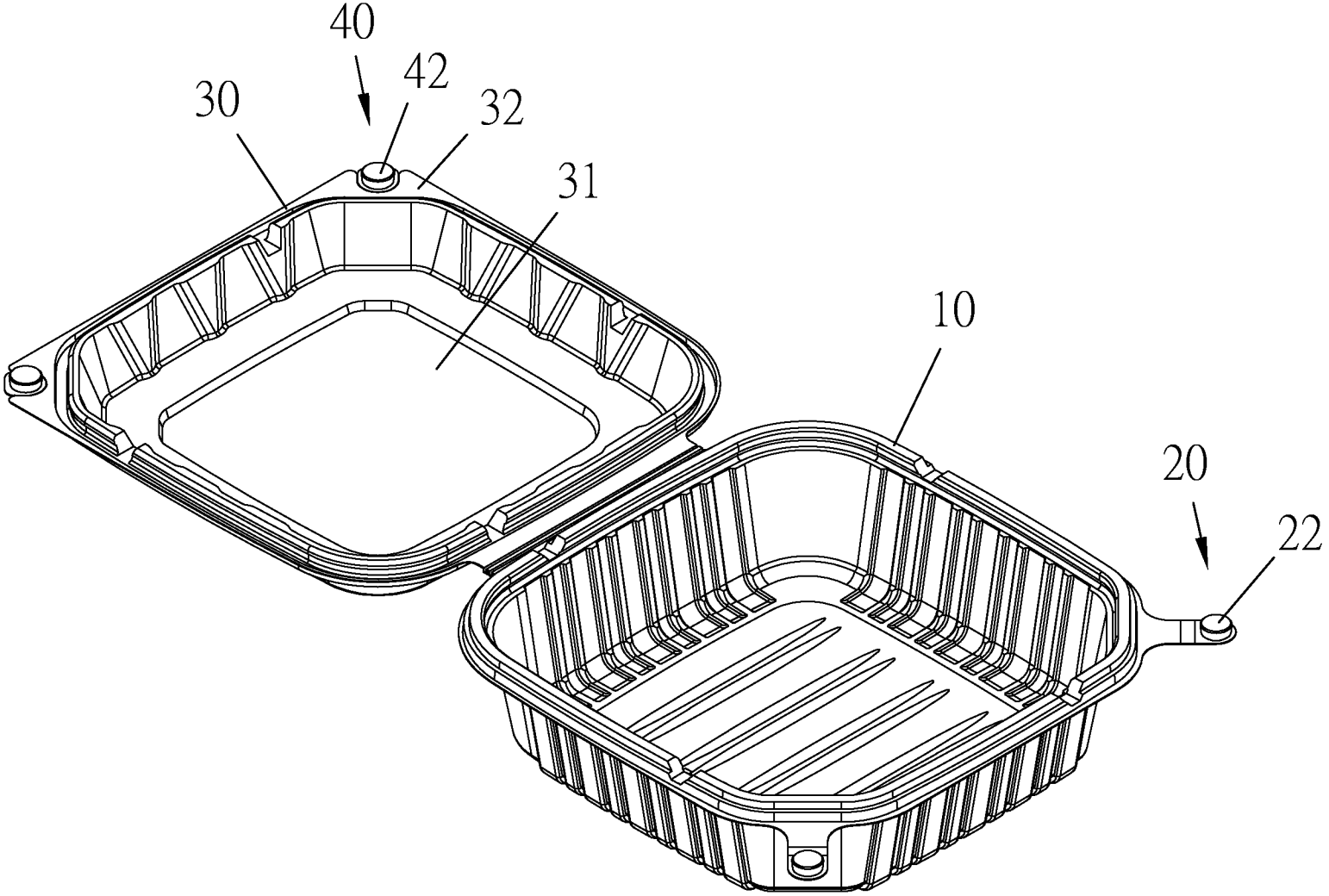
FIG. 9 is a perspective view showing the second embodiment of the present invention in an opened state.
Figure 10:
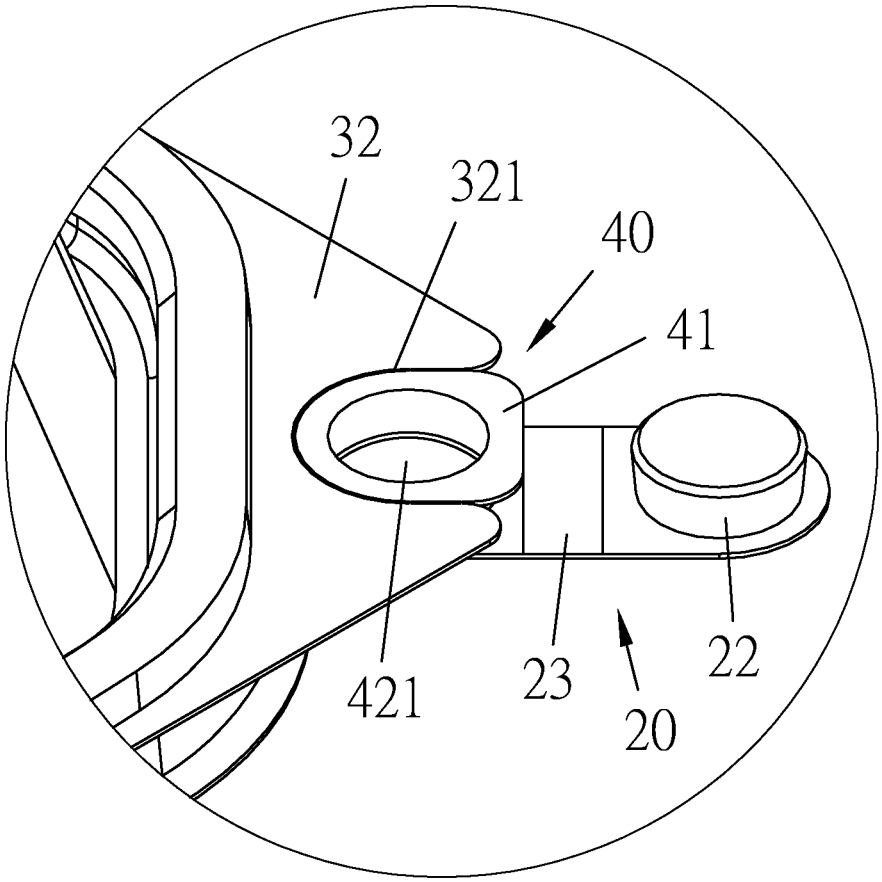
FIG. 10 is a perspective view showing a portion of the second embodiment of the present invention in an enlarged form.
Figure 11:
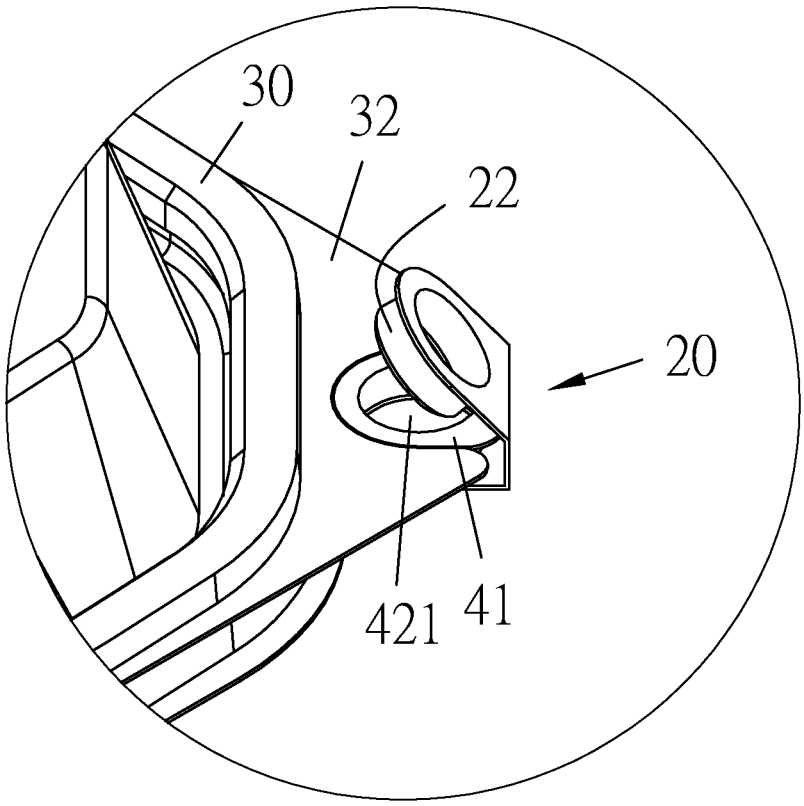
FIG. 11 is a schematic view, continuing from FIG. 10, showing a foldable member being folded.
Figure 12:
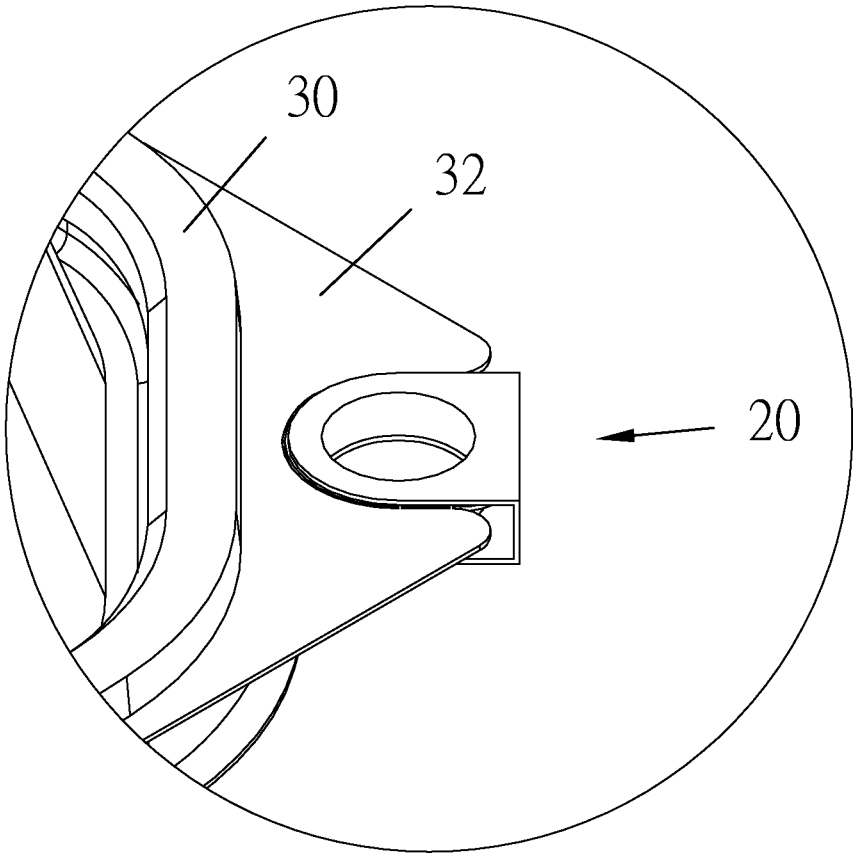
FIG. 12 is a perspective view, continuing from FIG. 11, showing an engaging member being combined with an opening.
Figure 13:
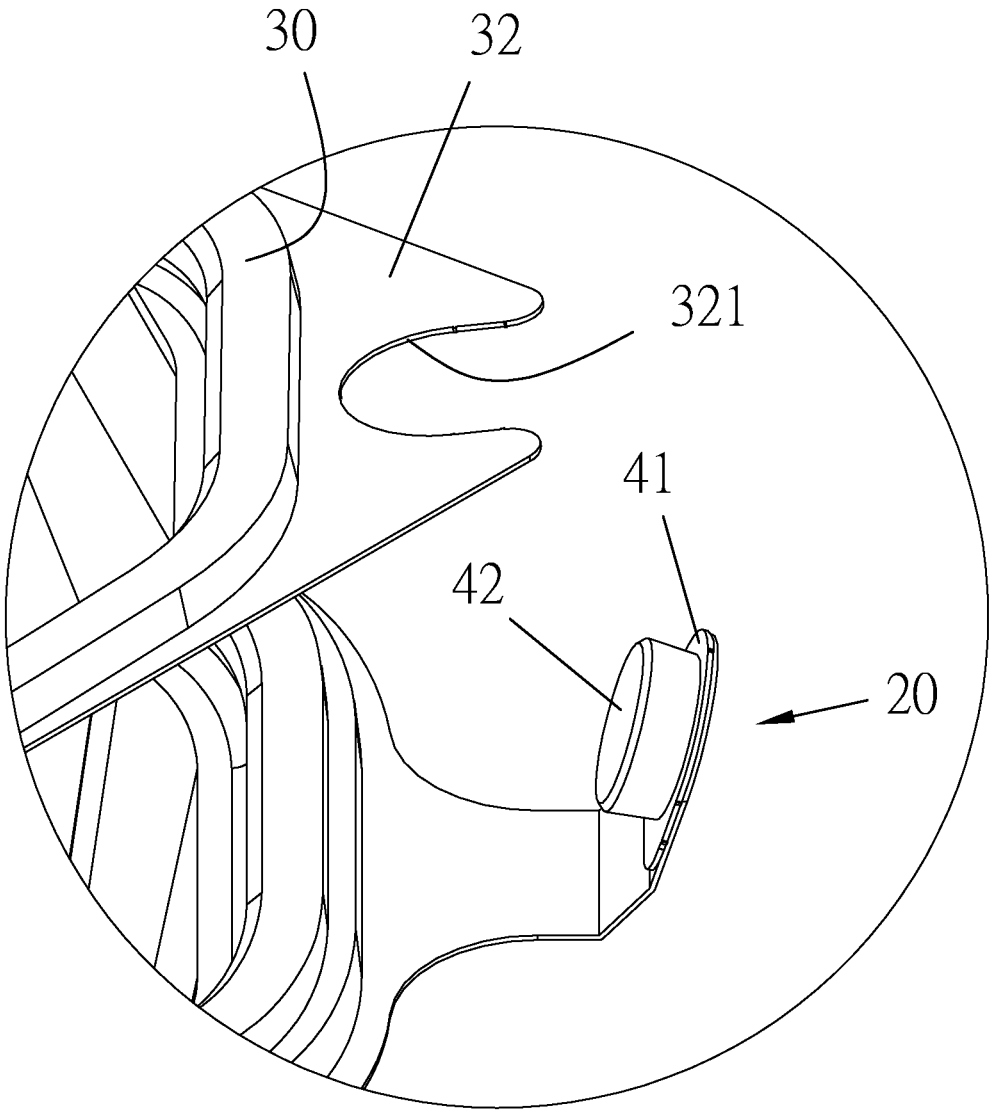
FIG. 13 is a schematic view, continuing from FIG. 12, illustrating a break-away unit being detached and separated from a notch.

Referring to FIG. 7, when the first casing member 10 is separated from the second casing member 30, the perforation line 43 is broken, so that the break-away unit 40 is detached from the second casing member 30, and at the same time, the folding portion 23 of the foldable member 20 causes an outward spring-back movement as being popping up. Since the folding portion 23 possesses certain elasticity, it is not possible to have the break-away unit 40 securely retained back onto the notch 321 through application of an external force. In this way, tamper-proofing can be achieved to allow a user to identify if the container has been opened.

Referring to FIGS. 8-13, a second embodiment of the present invention is shown.

Major components and structures of the instant embodiment are generally similar to those of the previous embodiment, so that repeated description will be omitted therein.

In the instant embodiment, the foldable member 20 is not limited to be connected to the first casing member 10 or the second casing member 30, and the insertion trough 21 of the foldable member 20 is made simplified, so that when the first casing member 10 and the second casing member 20 are combined, it only needs to have the engaging member 22 of the foldable member 20 engaging with and thus securely retained in the opening 421. When the first casing member 10 and the second casing member 20 are separated, the perforation line 43 is broken and at the same time, the folding portion 23 of the foldable member 20 springs back outwards for being popping up, and as such it is also effective in preventing the break-away unit 40 to fix back to the notch 321 through application of external forces. In this way, a user may easily identify if the container has been opened or not.

I claim:

1. A backward-folded opening-resistant container structure, comprising:

a first casing member;

at least one foldable member, the foldable member having an end connected to an outer side of the first casing member, the foldable member having an opposite end that is provided with an engaging member;

a second casing member, which has an interior that includes a receiving space, the first casing member being combinable with the second casing member in a detachable manner, in order to close the receiving space, the second casing member having a top from which at least one grip portion extends outward in a horizontal direction, the grip portion comprising a notch; and a break-away unit, which comprises a planar portion and a fastening portion, the planar portion having an outer side that is connected by means of a perforation line to the notch, the fastening portion comprising a hollow cylindrical body having an end that includes an opening, the opening having an outer side connected to the planar portion, wherein the foldable member is foldable to have the engaging member inserted into and combined in the opening, so that when the first casing member are the second casing member are separated, the perforation line is broken and the break-away unit is separated from the second casing member.

2. The backward-folded opening-resistant container structure according to claim 1, wherein the foldable member further comprises an insertion trough, the insertion trough having a width greater than the fastening portion, so that when the first casing member and the second casing member are combined, the fastening portion is received in the insertion trough, and the foldable member is subsequently foldable to have the engaging member engaging with and securely combining with the opening.

3. The backward-folded opening-resistant container structure according to claim 1, wherein a folding portion that is elastic is arranged between the engaging member and the insertion trough of the foldable member, so that when the first casing member are the second casing member are separated, the perforation line is broken and the break-away unit is separated from the second casing member and the folding portion of the foldable member springs back outward.

* * * * *